US009222377B2

(12) United States Patent
Boegershausen et al.

(10) Patent No.: US 9,222,377 B2
(45) Date of Patent: Dec. 29, 2015

(54) VOLUME STORE

(75) Inventors: Matthias Boegershausen, Puschendorf (DE); Michael Busse, Herzogenaurach (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 0 days.

(21) Appl. No.: 13/387,622

(22) PCT Filed: Jun. 24, 2010

(86) PCT No.: PCT/EP2010/059000
§ 371 (c)(1),
(2), (4) Date: Jan. 27, 2012

(87) PCT Pub. No.: WO2011/020636
PCT Pub. Date: Feb. 24, 2011

(65) Prior Publication Data

US 2012/0125272 A1 May 24, 2012

(30) Foreign Application Priority Data

Aug. 1, 2009 (DE) ..... 10 2009 035 815

(51) Int. Cl.

| | |
|---|---|
| ***F01L 9/02*** | (2006.01) |
| ***F01L 1/344*** | (2006.01) |
| ***F15B 1/24*** | (2006.01) |
| ***F15B 1/027*** | (2006.01) |
| ***F15B 1/04*** | (2006.01) |
| *F01L 1/047* | (2006.01) |

(52) U.S. Cl.
CPC ..... *F01L 1/344* (2013.01); *F15B 1/027* (2013.01); *F15B 1/04* (2013.01); *F15B 1/24* (2013.01); *F01L 2001/0475* (2013.01); *F01L 2001/34446* (2013.01); *F01L 2103/00* (2013.01); *F15B 2201/21* (2013.01); *F15B 2201/40* (2013.01); *F15B 2201/4056* (2013.01); *Y10S 303/11* (2013.01)

(58) Field of Classification Search
CPC ..... F15B 2201/21; F15B 2201/405; F15B 2201/4056; F15B 2201/40; F15B 2201/31; F15B 1/24; F15B 1/04; F15B 1/027; F01L 2001/34446; F01L 1/344; Y10S 303/11
USPC ..... 123/90.6, 90.15–90.17, 90.12, 90.38, 123/90.34; 138/31
See application file for complete search history.

(56) References Cited

U.S. PATENT DOCUMENTS

| | | | | |
|---|---|---|---|---|
| 2,715,419 | A * | 8/1955 | Ford et al. | 138/31 |
| 4,615,310 | A * | 10/1986 | Umeha et al. | 123/90.34 |
| 4,949,683 | A | 8/1990 | Swars | |
| 5,937,812 | A * | 8/1999 | Reedy et al. | 123/90.34 |
| 6,782,856 | B2 * | 8/2004 | Aimone | 123/90.34 |
| 7,013,854 | B1 | 3/2006 | Heintzen et al. | |
| 2003/0188705 | A1 | 10/2003 | Aimone | |
| 2009/0056656 | A1 | 3/2009 | Strauss | |

FOREIGN PATENT DOCUMENTS

| | | | |
|---|---|---|---|
| CN | 1724852 | A | 1/2006 |
| DE | 102 28 354 | A1 | 1/2004 |

(Continued)

*Primary Examiner* — Kenneth Bomberg
*Assistant Examiner* — Wesley Harris
(74) *Attorney, Agent, or Firm* — Davidson, Davidson & Kappel, LLC

(57) ABSTRACT

A volume store which has a substantially hollow cylindrical housing and a separating element displaceably disposed within the housing. The housing is fixedly disposed within a hollow chamber of a camshaft.

11 Claims, 2 Drawing Sheets

(56) References Cited

FOREIGN PATENT DOCUMENTS

| | | | | | |
|---|---|---|---|---|---|
| DE | 10 2006 035 034 | A1 | | 1/2008 | |
| DE | 10 2007 041 552 | A1 | | 3/2009 | |
| DE | 10 2007 056 683 | A1 | | 5/2009 | |
| EP | 1930603 | A1 | * | 6/2008 | ..... F15B 1/24 |
| FR | 2 626 950 | A1 | | 8/1989 | |
| WO | 2008/140897 | A1 | | 11/2008 | |
| WO | 2010/040617 | A1 | | 4/2010 | |

* cited by examiner

VOLUME STORE

CROSS-REFERENCE TO RELATED APPLICATIONS

This application is a 371 of PCT/EP2010/059000 filed Jun. 24, 2010, which in turn claims the priority of DE 10 2009 035 8153 filed Aug. 1, 2009. The priority of both applications is hereby claimed and both applications are incorporated by reference herein.

FIELD OF THE INVENTION

The invention relates to a volume store that has a housing of substantially hollow-cylindrical configuration, which is arranged non-displaceably within a cavity of a camshaft and a separating element which is arranged displaceably within the housing.

BACKGROUND OF THE INVENTION

Volume stores are used in internal combustion engines, in order for it to be possible to satisfy brief consumption peaks of hydraulic medium. One field of use lies, for example, in the area of camshaft adjustment, by way of which a phase position between a crankshaft and a camshaft can be configured in a variable manner.

The camshaft adjuster is integrated into a drive train, via which torque is transmitted from the crankshaft to the camshaft. The phase adjustment usually takes place by means of a hydraulic actuating drive which is fed with pressure medium by a pressure medium pump of the internal combustion engine. If rapid phase adjustments over a large phase angle are required during the operation of the internal combustion engine, the required pressure medium volume can exceed the pressure medium volume which is conveyed by the pressure medium pump. In this case, the difference is provided from the volume store. Furthermore, the volume store assists the camshaft adjustment in operating phases, in which the speed-dependent delivery volume of the pressure medium pump is too low to sufficiently supply the camshaft adjuster. This is usually the case at low speeds and high pressure medium temperatures. Moreover, the volume store assists the camshaft adjuster when a basic position is reached during the switch off operation of the internal combustion engine.

A volume store for assisting a camshaft adjuster is known, for example, from DE 102 28 354 A1. The volume store is arranged in a cavity of a camshaft, a piston being arranged within the cavity such that it can be displaced axially against a pneumatic spring. The pressure medium feed to the camshaft adjuster and the volume store takes place via a common feed line via a camshaft bearing. During the operation of the internal combustion engine, the volume store is filled in operating phases of low pressure medium consumption. This pressure medium volume which is stored in the volume store is available to the camshaft adjuster in operating phases with relatively high pressure medium consumption. In order to prevent pressure medium from flowing out of the volume store in the direction of the pressure medium pump, a nonreturn valve is usually provided upstream of the camshaft bearing. This is disclosed, for example, in DE 10 2007 056 683 A1, in which the method of operation of a camshaft adjuster of vane cell design is also explained.

SUMMARY OF THE INVENTION

The invention is based on the object of specifying a volume store, which is arranged in a cavity of a camshaft. The present invention reduces cost and the complexity of production.

According to the invention, the object is achieved by the fact that the axial ends of the volume store bear against, in each case, one conical bearing face, which bearing faces are arranged within the cavity. Here, for example, the housing or an intermediate component, which is connected to the housing or reaches behind it in the direction of the conical bearing face, can bear against the conical bearing face.

The separating element, for example an axially displaceable piston, is arranged within the housing. An inner circumferential face of the housing serves as a running face for the piston. The high requirements of the accuracy of the running face can be met in the housing without additional complexity, for example by a chipless forming process or a deep drawing process.

The invention proposes for the first time to fix the housing of a volume store, which is arranged within a cavity of a camshaft, non-displaceably between two conical bearing faces. As a result of the conical bearing faces, the housing is arranged centrically with respect to the camshaft axis, the centering taking place automatically during the mounting of the volume store. It is provided here that an internal diameter of the cavity of the camshaft is configured to be greater than an external diameter of the housing. The housing therefore does not bear against the circumferential face of the cavity. There is therefore no risk of the housing being deformed by unevennesses on the circumferential face of the camshaft, which could lead to jamming of the separating element.

Since firstly the piston runs along a highly precise face of the housing, which face is produced in a cost neutral manner, and secondly the housing does not have any contact points with the circumferential face of the cavity of the camshaft, expensive remachining of the circumferential face can be dispensed with.

It can be provided here that one of the conical bearing faces is formed on a circumferential face of the cavity. As an alternative, it can be provided that at least one of the conical bearing faces is formed on a separate component which is fastened fixedly to the camshaft, and therefore immovably with respect to the latter. Here, embodiments are conceivable, in which one of the conical bearing faces, against which one axial end of the housing bears, is formed directly on a circumferential face of the cavity of the camshaft, while the other axial end of the housing bears against a conical bearing face of a separate component. As an alternative, both ends of the housing can bear against conical bearing faces of a separate component.

The separate component which has the conical bearing face can be connected to the camshaft, for example the circumferential face of the cavity of the camshaft, in a positively locking, material to material or nonpositively locking manner. The housing is thus clamped in the axial direction between two components which are fixed to the camshaft, the conical bearing faces centering the housing during mounting and suppressing a radial movement of the housing. Here, the connection between the separate component and the camshaft can be produced, for example, by means of a press fit, a welded connection or a brazed connection.

The conical bearing face can be formed on an outer circumferential face of the separate component and engages into the housing. As an alternative, it can be provided that the conical hearing face is formed on an inner circumferential face of the separate component, into which the housing engages.

BRIEF DESCRIPTION OF THE DRAWINGS

Further features of the invention result from the following description and from the drawings, in which exemplary embodiments of the invention are shown in simplified form and in which.

DETAILED DESCRIPTION OF THE INVENTION

Figure 1:
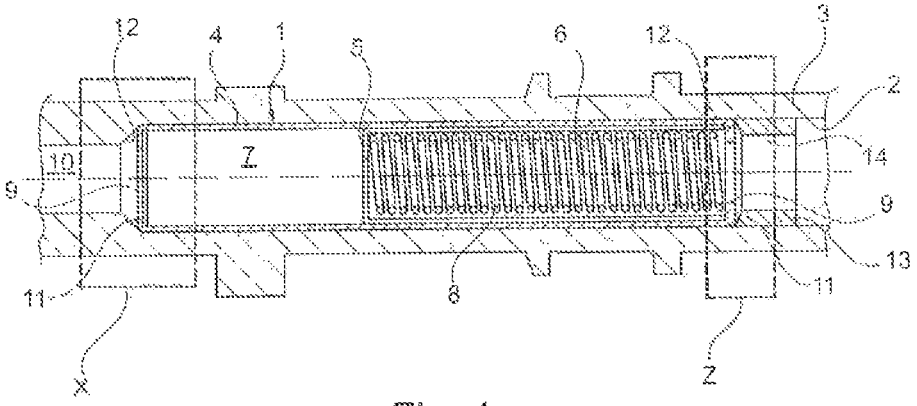
FIG. 1 shows a longitudinal section through a first embodiment according to the invention of a volume store within a camshaft.

FIG. 1 shows a volume store 1 which is arranged within a cavity 2 of a camshaft 3. The volume store has a housing 4, a separating element 5 which is configured as a piston 5, and a spring element 6. The piston 5 is configured as a thin-walled, cup-shaped sheet metal component and is mounted axially displaceably within the housing 4. Here, the piston 5 divides the interior of the housing 4 into a storage space 7 and a complementary space 8. The housing 4 is of substantially hollow-cylindrical configuration with in each case one opening 9 at each axial end side, the housing 4 extending radially inward at its axial ends 11.

The spring element 6 is arranged in the complementary space 8, which spring element 6 is supported firstly on that side of the piston 5 which faces away from the storage space 7 and secondly on the radially inwardly extending region of the housing 4. During the operation of the internal combustion engine, pressure medium is fed via a pressure medium line 10 and the storage space-side opening 9 to the storage space 7, and the piston 5 is therefore displaced counter to the force of the spring element 6. Here, the volume of the storage space 7 increases at the expense of the volume of the complementary space 8. If the pressure medium volume which is required by a consumer, for example a camshaft adjuster, exceeds the pressure medium volume which is delivered by a pressure medium pump, the piston 5 is displaced in the opposite direction on account of the force which is exerted on it by the spring element 6, and pressure medium is therefore fed to the pressure medium line 10 out of the storage space 7.

The axial ends 11 of the housing 4 bear in each case against a conical bearing face 12 (FIGS. 2 and 3), as a result of which the housing 4 is centered with respect to the longitudinal axis of the cavity 2. Since the external diameter of the housing 4 of substantially hollow-cylindrical configuration is configured to be smaller than the internal diameter of the circumferential face of the cavity 2 of the camshaft 3, the housing 4 does not bear against any point of the circumferential face of the cavity 2. There is therefore no risk of the housing 4 being deformed during the positioning in the cavity 2 by unevennesses on the circumferential face of the latter. This ensures that the piston 5 is not jammed within the housing 4, but rather can be displaced in an easy running manner. Expensive and time-consuming remachining of the circumferential face of the cavity 2 of the camshaft 3 with the removal of material is therefore dispensed with. The inner circumferential face of the housing 4 can be produced by corresponding production processes in a cost neutral manner with respect to the requirements which are made of an optimum running face for the piston 5. Here, chipless production processes can be used, for example deep drawing processes, by way of which surfaces of corresponding quality are produced automatically.

Figure 2:
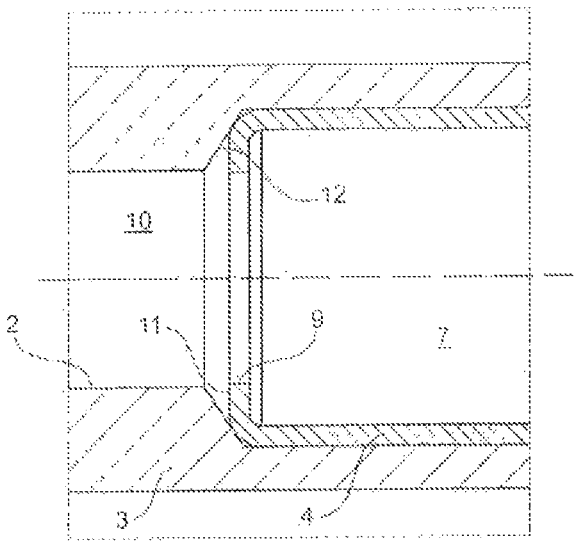
FIG. 2 shows an enlarged illustration of the detail X from FIG. 1.

In the embodiment which is shown, the storage space-side end of the housing 4 bears against a rotationally symmetrical, conical bearing face 12 which is formed directly on the circumferential face of the cavity 2 of the camshaft 3 (FIG. 2). The conical bearing face 12 is formed on an inner circumferential face of the cavity 2 and the axial end 11 of the housing 4 engages into the region of the inner cone.

Figure 3:
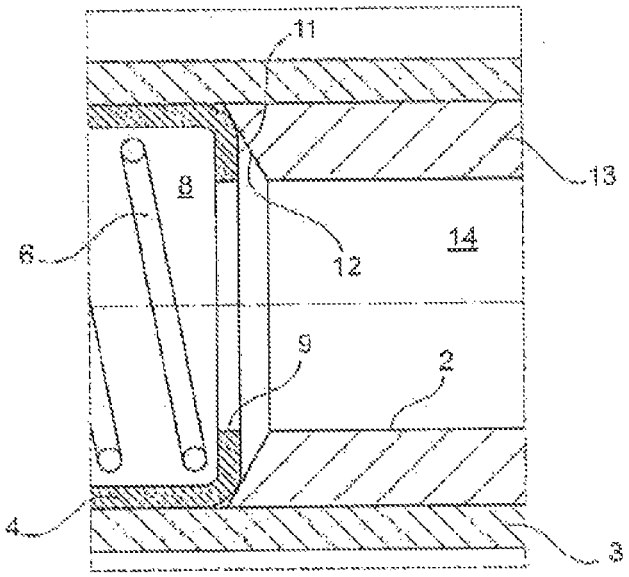
FIG. 3 shows an enlarged illustration of the detail Z from FIG. 1.

The other axial end 11 of the housing 4 bears against a conical bearing face 12 of a component 13 which has been manufactured separately to the volume store 1 and the camshaft 3 and has been subsequently connected by means of a press fit to the inner circumferential face of the cavity 2 of the camshaft 3 (FIG. 3). The conical bearing face 12 is formed on an inner circumferential face of the component 13 and the axial end 11 of the housing 4 engages into the region of the inner cone. The component 13 has a central through opening 14, via which the complementary space 8 communicates with the interior of the internal combustion engine. The complementary space 8 can therefore be ventilated and pressure medium can escape from it.

Figure 4:
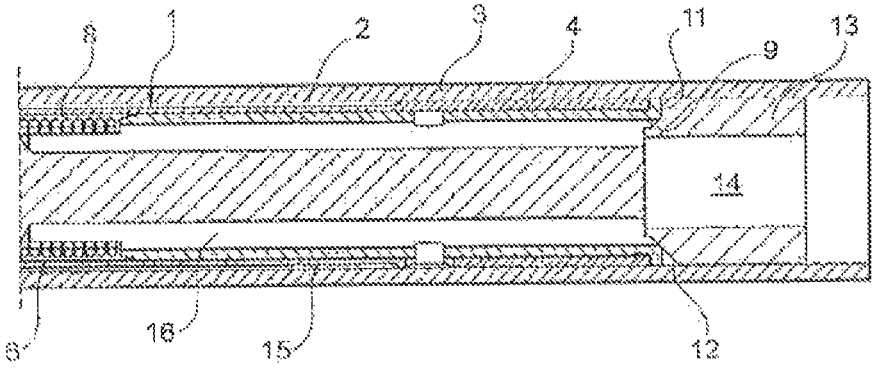
FIG. 4 shows a partial longitudinal section through a second embodiment according to the invention of a volume store within a camshaft.

FIG. 4 shows a partial longitudinal section through a second volume store 1 according to the invention which is arranged in a cavity 2 of a camshaft 3. Here, only the region of the complementary space 8 is shown. In contrast to the first embodiment, a guide element 15 is additionally provided which supports the spring element 6 radially and on which the spring element 6 is supported axially. The guide element 15 has axial ventilating channels 16 which communicate with the through opening 14 and the space in which the spring element 6 is accommodated.

Moreover, the conical bearing face 12 of the separate component 13 is formed on an outer circumferential face of the component 13, the outer cone which is formed as a result engaging into the housing 4. In this embodiment, it is not the housing 4 but rather the guide element 15 which bears against the conical bearing face 12, which guide element 15 reaches behind the housing in the direction of the conical bearing face 12. Therefore, in the axial direction, the guide element 15 bears against the conical bearing face 12 and the housing 4 bears against the guide element 15, as a result of which said housing 4 is fixed centrically within the camshaft 3.

LIST OF DESIGNATIONS

1 Volume Store
2 Cavity
3 Camshaft
4 Housing
5 Separating Element/Piston
6 Spring Element
7 Storage Space
8 Complementary Space
9 Opening
10 Pressure Medium Line
11 Axial End
12 Conical Bearing Face
13 Component
14 Through Opening
15 Guide Element
16 Ventilating Channels

The invention claimed is:

1. An assembly comprising:

a camshaft including an inner surface, the inner surface including a first conical bearing face and a cylindrical circumferential face extending axially from the first conical bearing face;

a separate component fixed in the camshaft at the cylindrical circumferential face, the separate component including a second conical bearing face, the first conical bearing face, the second conical bearing face and the cylindrical circumferential face defining a cavity inside the camshaft; and a volume store comprising:

a cylindrical housing, which is arranged non-displaceably within the cavity of a camshaft, having axial ends each including an opening therein, a first of the axial ends including a first radially inwardly extending region;

a separating element, which is arranged displaceably within the housing; and a spring element supported firstly on a side of the separating element facing away from a storage space and secondly on the first radially inwardly extending region of the housing, the axial ends of the housing each bearing against one of the conical bearing faces.

2. The assembly as claimed in claim 1, wherein an internal diameter of the cavity is greater than an external diameter of the housing.

3. The assembly as claimed in claim 1, wherein the first and second conical surfaces fix the housing concentrically with respect to a camshaft axis of the camshaft.

4. The assembly as claimed in claim 1, wherein a second of the axial ends includes a second radially inwardly extending region.

5. The assembly as claimed in claim 1, wherein the separating element is a cup-shaped sheet metal component circumferentially surrounding the spring.

6. An assembly, comprising:

a camshaft including an inner surface, the inner surface including a first conical bearing face and a cylindrical circumferential face extending axially from the first conical bearing face;

a separate component fixed in the camshaft at the cylindrical circumferential face, the separate component including a second conical bearing face, the first conical bearing face, the second conical bearing face and the cylindrical circumferential face defining a cavity inside the camshaft; and a volume store comprising a cylindrical housing having axial ends and a separating element, each of the axial ends including an opening therein, the housing is arranged non-displaceably within the cavity of the camshaft with the axial ends of the housing each bearing against one of the first and second conical bearing faces and the separating element is arranged displaceably within the housing, the volume store including a spring element supported on a side of the separating element facing away from a storage space, an external diameter of the substantially hollow-cylindrical housing being smaller than an internal diameter of the cylindrical circumferential face of the camshaft such that the housing is held solely by the first and second conical bearing faces and does not bear against any point of the cylindrical circumferential face.

7. The assembly as claimed in claim 6, wherein the first conical end face is at a first of the axial ends and the second conical end face contacts a second of the axial ends, the separate component including an axial through opening formed therein.

8. The assembly as claimed in claim 7, wherein the first axial end includes a first radially inwardly extending region, the spring element being also supported on the first radially inwardly extending region of the housing, the first radially inwardly extending region contacting first conical end face.

9. The assembly as claimed in claim 8, wherein the second axial end includes a second radially inwardly extending region, the second radially inwardly extending region contacting second conical end face.

10. The assembly as claimed in claim 9, wherein the first radially inwardly extending region and the second radially inwardly extending region of the housing are each aligned perpendicular to a camshaft axis of the camshaft.

11. The assembly as claimed in claim 6, wherein the separating element is a cup-shaped sheet metal component circumferentially surrounding the spring.

* * * * *